US010279452B2

(12) United States Patent
Yamanaka

(10) Patent No.: US 10,279,452 B2
(45) Date of Patent: May 7, 2019

(54) PROCESSING APPARATUS

(71) Applicant: DISCO CORPORATION, Tokyo (JP)

(72) Inventor: Satoshi Yamanaka, Tokyo (JP)

(73) Assignee: Disco Corporation, Tokyo (JP)

( * ) Notice: Subject to any disclaimer, the term of this patent is extended or adjusted under 35 U.S.C. 154(b) by 41 days.

(21) Appl. No.: 15/720,758

(22) Filed: Sep. 29, 2017

(65) Prior Publication Data

US 2018/0093361 A1 Apr. 5, 2018

(30) Foreign Application Priority Data

Sep. 30, 2016 (JP) ..... 2016-193734

(51) Int. Cl.

| | |
|---|---|
| ***B24B 41/06*** | (2012.01) |
| ***B24B 37/27*** | (2012.01) |
| ***B24B 7/22*** | (2006.01) |
| ***B24B 37/34*** | (2012.01) |
| ***B24B 57/02*** | (2006.01) |

(52) U.S. Cl.

CPC ..... *B24B 37/27* (2013.01); *B24B 7/22* (2013.01); *B24B 37/34* (2013.01); *B24B 57/02* (2013.01)

(58) Field of Classification Search

CPC ..... B24B 41/06
USPC ..... 451/388, 398, 364, 5, 41, 73
See application file for complete search history.

(56) References Cited

U.S. PATENT DOCUMENTS

| | | | | |
|---|---|---|---|---|
| 4,521,995 A * | 6/1985 | Sekiya | ..... | B24B 37/30 125/35 |
| 5,906,532 A * | 5/1999 | Nakajima | ..... | B24B 37/30 451/285 |
| 6,276,998 B1 * | 8/2001 | Sommer | ..... | B24B 37/32 257/E21.23 |
| 8,021,211 B2 * | 9/2011 | Chen | ..... | B24B 37/30 451/289 |

FOREIGN PATENT DOCUMENTS

JP 2014-004658 A 1/2014

* cited by examiner

*Primary Examiner* — Robert Rose
(74) *Attorney, Agent, or Firm* — Greer Burns & Crain, Ltd.

(57) ABSTRACT

Disclosed herein is a carrying mechanism that carries a plate-shaped workpiece in which a substrate larger than a wafer in area is stacked on a lower surface of the wafer. The carrying mechanism includes a carrying pad for covering an upper surface of the wafer, holding sections for holding the substrate on outside of the outer periphery of the wafer, and a water supply source for supplying water to the wafer. The carrying mechanism forms a predetermined gap between the lower surface of the carrying pad and the upper surface of the wafer, and carries the plate-shaped workpiece in a condition where the gap is supplied with a predetermined amount of water.

1 Claim, 5 Drawing Sheets

PROCESSING APPARATUS

BACKGROUND OF THE INVENTION

Field of the Invention

The present invention relates to a processing apparatus provided with a carrying mechanism for carrying a workpiece.

Description of the Related Art

As a polishing apparatus for polishing a wafer, for example, there has been proposed one that performs chemical mechanical polishing (CMP). In such a polishing apparatus, polishing is conducted using abrasive grains and a slurry. Specifically, a slurry containing abrasive grains is fixed between a polishing pad and a wafer, and the slurry is pressed against the wafer, to thereby polish the surface of the wafer.

The wafer thus polished is carried to cleaning means. However, during the carrying, the surface (polished surface) of the wafer may dry and the slurry adhering to the surface of the wafer may solidify. Since the solidified slurry is difficult to remove by the cleaning means, drying of the surface of the wafer is undesirable.

In the past, therefore, a carrying mechanism has been proposed by which a wafer is carried while supplying water to the surface of the wafer (see Japanese Patent No. 5930196). The carrying mechanism of Japanese Patent No. 5930196 is an edge clamp type carrying mechanism, in which water is constantly supplied to the surface of the wafer during when the wafer is being held. As a result, the wafer is prevented from drying.

SUMMARY OF THE INVENTION

However, in the carrying mechanism described in Japanese Patent No. 5930196, spilling of water from the surface of the wafer is assumed, and, based on the assumption, water is supplied to the wafer incessantly. This leads to the problem of an increased consumption of water.

Accordingly, it is an object of the present invention to provide a processing apparatus by which a wafer can be carried with its surface kept in a wet state, while suppressing consumption of water.

In accordance with an aspect of the present invention, there is provided a processing apparatus including a holding table, processing means, cleaning means, and a carrying mechanism. The holding table holds a substrate of a plate-shaped workpiece under suction including a wafer and the substrate stacked on each other with their centers in register, the substrate being larger than the wafer in area, the substrate protruding to outside of an outer periphery of the wafer to form a protruding portion. The processing means processes an upper surface of the wafer of the plate-shaped workpiece held by the holding table. The cleaning means cleans a processed surface of the wafer having been processed by the processing means. The carrying mechanism carries the wafer from the holding table to the cleaning means. The carrying mechanism includes a holding section that holds the protruding portion, a carrying pad that has a lower surface destined to face the upper surface of the wafer of the plate-shaped workpiece held by the holding section, with the lower surface of the carrying pad being equal to or larger than the upper surface of the wafer in area, and water supplying means for supplying water via the lower surface of the carrying pad. A gap is provided between the upper surface of the plate-shaped workpiece held by the holding section and the lower surface of the carrying pad, water is supplied into the gap by the water supplying means, then, when the gap is filled up with the water, the supply of water from the water supplying means is cut off, and the plate-shaped workpiece is carried from the holding table to the cleaning means with the gap kept filled up with the water.

According to this configuration, the lower surface of the carrying pad is equal to or larger than the upper surface of the wafer in area. For this reason, during when the wafer is carried, with the center of the carrying pad and the center of the wafer being in register, the upper surface of the wafer is entirely covered with the carrying pad. In addition, water is supplied from the water supplying means, whereby a layer of water is formed in a gap between the lower surface of the carrying pad and the upper surface of the wafer. As a result, the upper surface of the wafer is entirely covered with the layer of water. In this instance, due to the surface tension of water between the carrying pad and the wafer, the layer of water is maintained in the gap, so that it is unnecessary to supply the water continuously. In other words, the wet state of the upper surface of the wafer can be maintained with a predetermined amount of water. Consequently, the wafer can be carried with its upper surface kept in a wet state while suppressing consumption of water.

Thus, according to the present invention, a wafer can be carried with its surface kept in a wet state, while suppressing consumption of water.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
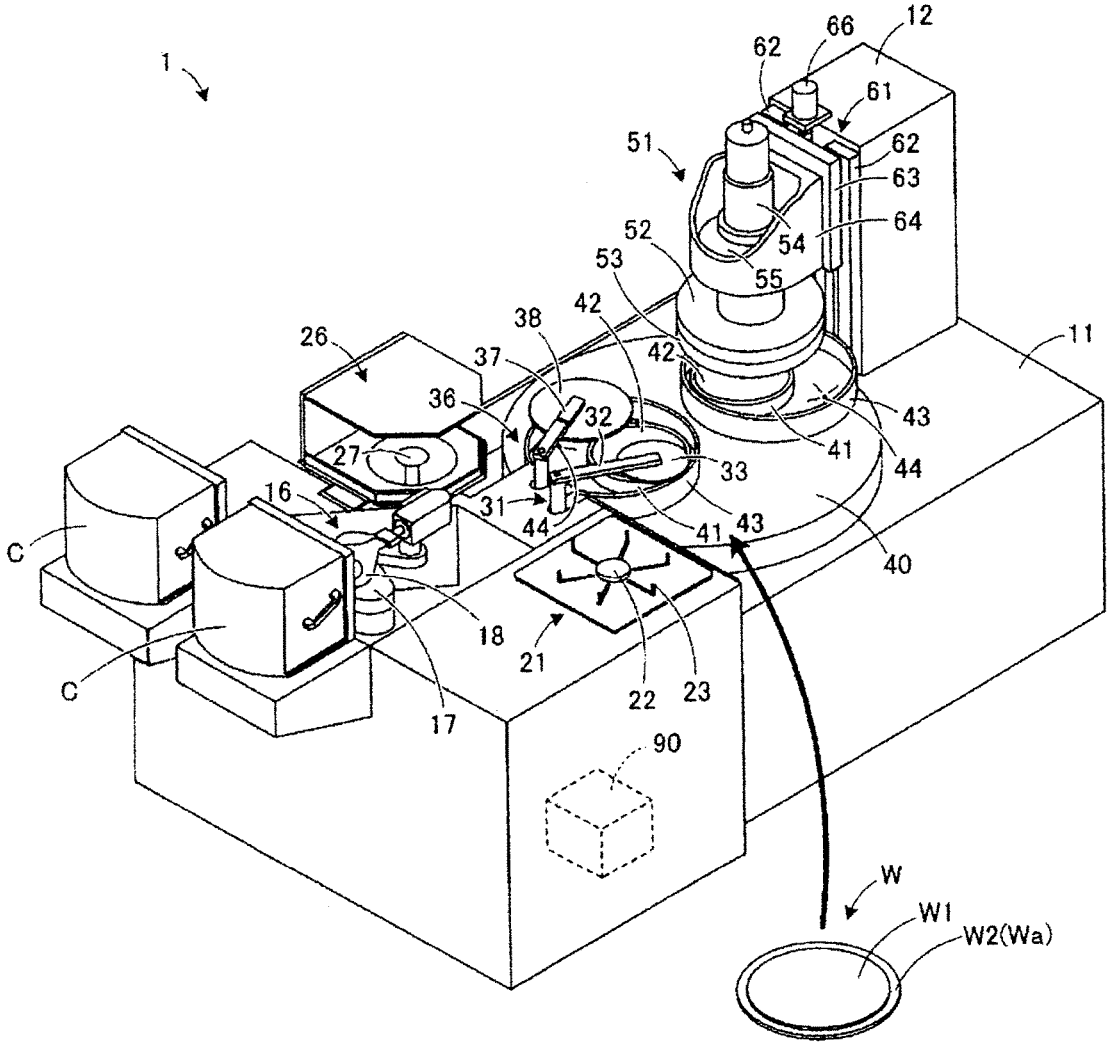
FIG. 1 is a perspective view of a CMP polishing apparatus according to an embodiment of the present invention.

A CMP polishing apparatus according to an embodiment of the present invention will be described below, referring to the attached drawings. FIG. 1 is a perspective view of the CMP polishing apparatus according to the present embodiment. Note that the CMP polishing apparatus according to the present embodiment is not limited to the apparatus configuration for exclusive use in polishing as illustrated in FIG. 1, but may be incorporated in a full-automatic type processing apparatus designed to fully automatically perform a series of operations such as, for example, grinding, polishing, and cleaning. In addition, while a case where a CMP polishing apparatus is used as a processing apparatus is taken as an example in the description of the present embodiment, this is not restrictive, and the processing apparatus may be a grinding apparatus, for example.

As illustrated in FIG. 1, a CMP polishing apparatus 1 is configured to fully automatically perform a series of operations of carrying-in, polishing, cleaning, and carrying-out a plate-shaped workpiece W. The plate-shaped workpiece W is formed in a substantially circular disk shape, and is carried in to the CMP polishing apparatus 1 in the state of being accommodated in plurality in a cassette C.

Note that the plate-shaped workpiece W is configured as a stacked workpiece in which a wafer W1 is stacked on an upper surface of a substrate W2 larger than the wafer W1 in area, with their centers in register. Therefore, the substrate W2 protrudes to the outside of an outer periphery of the wafer W1, to form a protruding portion Wa. Note that the wafer W1 may be a semiconductor wafer having semiconductor devices such as integrated circuits (ICs) or large-scale integrations (LSIs) formed on a semiconductor substrate, or may be an optical device wafer having optical devices such as light-emitting diodes (LEDs) formed on an inorganic material substrate. Further, the wafer W1 may be a semiconductor substrate or inorganic material substrate formed with other devices.

On the front side of a base 11 of the CMP polishing apparatus 1, there are mounted a pair of cassettes C in each of which a plurality of the plate-shaped workpieces W are accommodated. On the rear side of the pair of cassettes C is provided a cassette robot 16 by which the plate-shaped workpiece W is carried into and out of the cassette C. On skew rear sides of the cassette robot 16, there are provided a positioning mechanism 21 for positioning the plate-shaped workpiece W yet to be processed, and cleaning means 26 for cleaning the plate-shaped workpiece W having been processed. Between the positioning mechanism 21 and the cleaning means 26, there are provided a carrying mechanism 31 by which the plate-shaped workpiece W yet to be processed is carried onto a holding table 41, and a carrying mechanism 36 (corresponding to a carrying mechanism according to the present invention) by which the plate-shaped workpiece W having been processed is carried out from the holding table 41.

The cassette robot 16 includes a hand portion 18 provided at a tip of a robot arm 17 including a multi-joint link. By the cassette robot 16, the plate-shaped workpiece W yet to be processed is carried from the cassette C to the positioning mechanism 21, and, in addition, the plate-shaped workpiece W having been processed is carried from the cleaning means 26 to the cassette C.

The positioning mechanism 21 has a configuration in which a plurality of positioning pins 23 which can be advanced and retracted in relation to the center of a temporary placing table 22 are arranged in the periphery of the temporary placing table 22. At the positioning mechanism 21, the plurality of positioning pins 23 are abutted on an outer peripheral edge of the plate-shaped workpiece W placed on the temporary placing table 22, whereby the center of the plate-shaped workpiece W is positioned in the center of the temporary placing table 22.

At the carrying mechanism 31, the plate-shaped workpiece W is lifted up from the temporary placing table 22 by a carrying pad 33, and the carrying pad 33 is slewed by a carrying arm 32, whereby the plate-shaped workpiece W is carried onto the holding table 41. At the carrying mechanism 36, the plate-shaped workpiece W is lifted up from the holding table 41 by a carrying pad 38, and the carrying pad 38 is slewed by a carrying arm 37, whereby the plate-shaped workpiece W is carried out from the holding table 41. The plate-shaped workpiece W thus carried out is carried to the cleaning means 26.

The cleaning means 26 is provided with various nozzles (not depicted) for jetting cleaning water and drying air toward a spinner table 27. By the cleaning means 26, the spinner table 27 with the plate-shaped workpiece W held thereon is lowered into the base 11, the cleaning water is jetted in the base 11 to perform spinner cleaning of the plate-shaped workpiece W (a processed surface of the wafer W1), and thereafter the drying air is blown to the plate-shaped workpiece W, whereby the plate-shaped workpiece W is dried.

On the rear side of the carrying mechanism 31 and the carrying mechanism 36 is provided a turntable 40. That area adjacent to the turntable 40 which is on the side of the carrying mechanism 31 and the carrying mechanism 36 constitutes a carrying area where the plate-shaped workpiece W is carried. That area adjacent to the turntable 40 which is on the rear side (the side of processing means 51 which will be described later) constitutes a processing area where the plate-shaped workpiece W is polished.

On an upper surface of the turntable 40, a pair of the holding tables 41 are provided at equal intervals in the circumferential direction. The turntable 40 can be rotated about its own axis by rotating means (not depicted). Each time the turntable 40 is rotated half a turn, the plate-shaped workpiece W held on the holding table 41 is positioned alternately into the carrying area and into the processing area.

The holding tables 41 are disposed at equal angular intervals around a rotational axis of the turntable 40. Under each of the holding tables 41 is provided rotating means (not depicted) for rotating the holding table 41. Each holding table 41 is formed at an upper surface thereof with a holding surface 42 for holding a lower surface of the plate-shaped workpiece W (the substrate W2). The holding table 41 is formed at the periphery thereof with an annular peripheral wall 43, and a jet port 44 connected to an air supply source (not depicted) adjacent to the holding table 41 is formed on the inside of the peripheral wall 43. On the inside of the peripheral wall 43, a slurry flowing down from the holding table 41 during polishing is accumulated, and air is jetted from the jet port 44, whereby the slurry is supplied to a polishing pad 53 and reused.

In addition, a column 12 is erected on the rear side of the turntable 40. The column 12 is provided with processing feeding means 61 by which processing feed of the processing means 51 in a Z-axis direction is performed. The processing feeding means 61 includes a pair of guide rails 62 disposed on a front surface of the column 12 in parallel to the Z-axis direction, and a motor-driven Z-axis table 63 which is disposed to be slidable on the pair of guide rails 62.

On a front surface of the Z-axis table 63, the processing means 51 is supported through a housing 64. A nut section (not depicted) is formed on a back side of the Z-axis table 63, the nut section is in screw engagement with a ball screw (not depicted), and a driving motor 66 is connected to one end of the ball screw (not depicted). The ball screw (not depicted) is driven to rotate by the driving motor 66, whereby the processing means 51 is moved along the guide rails 62 in the Z-axis direction.

The processing means 51 polishes the plate-shape workpiece W (the upper surface of the wafer W1) held on the holding table 41. The processing means 51 is mounted to the front surface of the Z-axis table 63 through the housing 64, and has the polishing pad 53 provided at a lower portion of a spindle 54. The spindle 54 is provided with a flange 55, and the processing means 51 is supported by the housing 64 through the flange 55. A platen 52 to which the polishing pad 53 is to be mounted is attached to a lower portion of the spindle 54. The polishing pad 53 is formed in a polishing surface thereof with a multiplicity of holes for fixation of the slurry.

In addition, a slurry supply source (not depicted) for supplying the slurry between an upper surface of the plate-shaped workpiece W and the polishing surface of the polishing pad 53 is connected to an upper portion of the spindle 54. With the slurry supplied from the slurry supply source, the slurry is fixed to the polishing surface by way of a flow path formed in the spindle 54. The slurry is a basic or acidic aqueous solution containing abrasive grains, the abrasive grains being formed of, for example, green carborundum, diamond, alumina, cerium oxide, or cubic boron nitride (CBN).

The CMP polishing apparatus 1 is provided with control means 90 for integrated control of components of the apparatus. The control means 90 includes a processor for executing various processes, a memory and the like. The memory includes one or a plurality of storage media such as read only memory (ROM) or random access memory (RAM) according to the use.

In the CMP polishing apparatus 1 configured as above, the plate-shaped workpiece W is carried from the inside of the cassette C to the positioning mechanism 21, and is centered by the positioning mechanism 21. Next, the plate-shaped workpiece W is carried onto the holding table 41, and the turntable 40 is rotated, whereby the plate-shaped workpiece W held on the holding table 41 is positioned into a CMP polishing position. In the CMP polishing position, the plate-shaped workpiece W is polished by the processing means 51. Then, the plate-shaped workpiece W is cleaned by the cleaning means 26, and the cleaned plate-shaped workpiece W is carried out from the cleaning means 26 to the cassette C.

Meanwhile, in a conventional polishing apparatus, a wafer having been polished is cleaned by such spinner-type cleaning means as mentioned above. Specifically, in the cleaning means, a spinner table with the wafer held thereon under suction is rotated at high speed, and cleaning water is jetted to the wafer, thereby cleaning the wafer. In such a type of cleaning means, dirt (polishing swarf, the slurry, etc.) on the upper surface of the wafer is washed away by utilizing an outward flying-out force of the cleaning water due to a centrifugal force. Even if the dirt on the upper surface of the wafer is blown away by utilizing the centrifugal force, however, the slurry may remain on an outer peripheral portion of the wafer, so that a sufficient cleaning effect cannot always be obtained.

The dirt such as the slurry remaining on the outer peripheral portion of the wafer would solidify upon drying, and would become difficult to remove even when wetted with water again. Moreover, mixing of the slurry into the apparatus in subsequent steps may cause an unexpected trouble. In view of this, there has been proposed a carrying mechanism in which water is constantly supplied so that the upper surface of the wafer is not dried during when carried to the cleaning means after polished. However, the constant supply of water leads to wasteful use of water.

Besides, in recent years, further thinning of wafers is demanded, and there is a technology in which a substrate is adhered to a wafer with a wax, instead of adhering a protective tape to the lower surface of the wafer. This technology is used for preventing errors from being generated due to sinking of the protective tape or lateral sliding of the wafer, during processing of a wafer that needs a higher pressing load (e.g., polishing load), such as a SiC substrate or a sapphire substrate.

In view of the above-mentioned problems, the present inventors came to get an idea of carrying a wafer with its upper surface kept in a wetted state, while suppressing consumption of water. Specifically, in the present embodiment, at the time of carrying a wafer W1, the carrying pad 38 (see FIG. 2) is faced to the wafer W1 in such a manner as to cover entirely the upper surface of the wafer W1, and a predetermined amount of water is supplied into a gap formed between the lower surface of the carrying pad 38 and the upper surface of the wafer W1. The water supplied into the gap (a layer of the water) is maintained in the gap by surface tension, and, therefore, it is possible to restrain the upper surface of the wafer W1 from drying, by only supplying the predetermined amount of water. Thus, it has become possible to carry the wafer W1 with its upper surface kept in a wetted state, while saving water.

Figure 2:
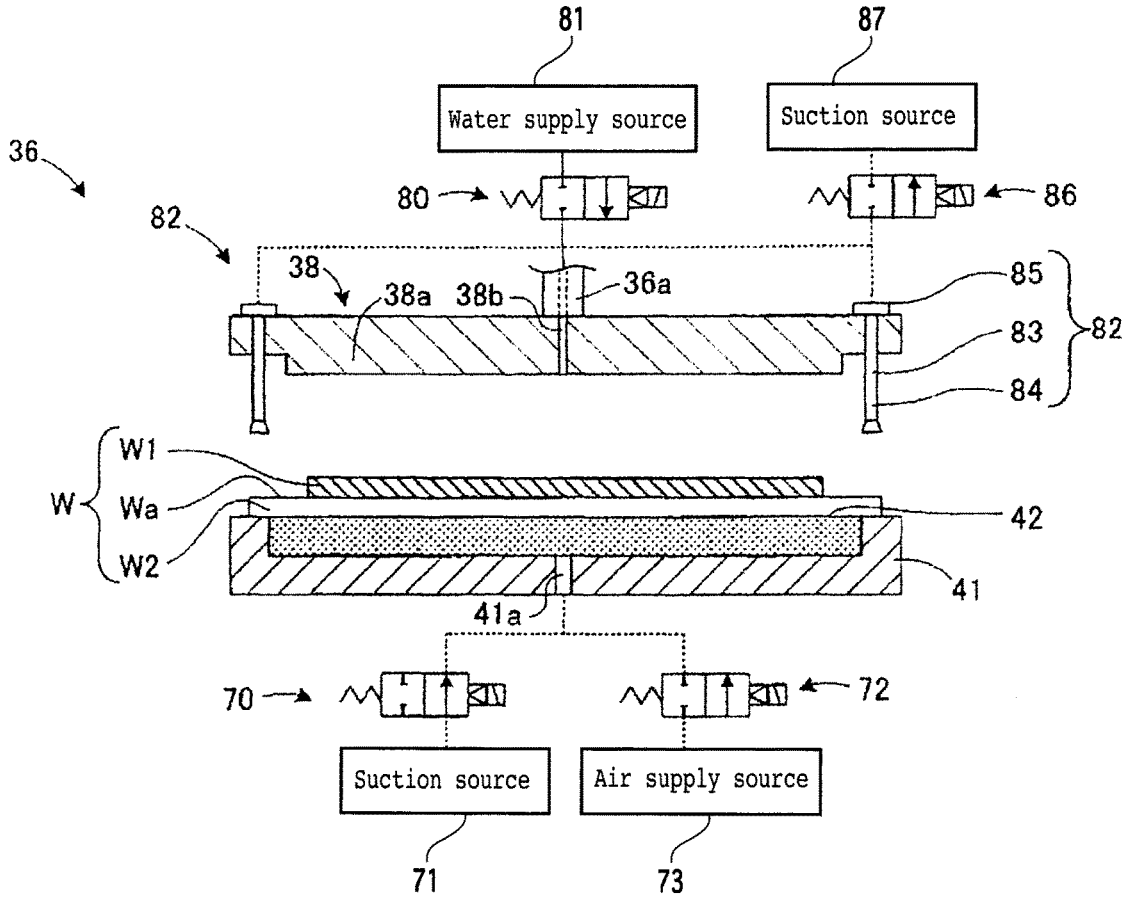
FIG. 2 is a schematic sectional view of a carrying mechanism according to the present embodiment.

Now, referring to FIG. 2, a detailed configuration of the carrying mechanism according to the present embodiment will be described below. FIG. 2 schematically depicts the carrying mechanism according to the present embodiment. Note that while a case of carrying a plate-shaped workpiece in which a substrate is stacked on a lower surface of a wafer is described in the present embodiment, this plate-shaped workpiece is not restrictive of the object to be carried. As illustrated in FIG. 2, the carrying mechanism 36 according to the present embodiment is configured such that a plate-shaped workpiece W having been polished is carried out from the holding table 41 and carried to the cleaning means 26 (see FIG. 1).

The holding table 41 holds the lower surface of the plate-shaped workpiece W under suction. Specifically, at a surface of the holding table 41, a holding surface 42 for holding the substrate W2 of the plate-shaped workpiece W under suction is formed from a porous material such as porous ceramic. The holding surface 42 has an outside diameter slightly smaller than the outside diameter of the substrate W2. The holding table 41 is formed with a communication hole 41*a* communicating with the holding surface 42. The communication hole 41*a* is connected with a suction source 71 through a valve 70, and with an air supply source 73 through a valve 72. Note that during when the plate-shaped workpiece W is held by the holding table 41, the valve 70 is open, whereas the valve 72 is closed.

The carrying mechanism 36 includes the carrying pad 38 supported on a tip of the carrying arm 37 (which is slewable) (see FIG. 1) through a shaft portion 36*a*. The carrying pad 38 is formed in a substantially circular disk shape, with the shaft portion 36*a* as a center, and the carrying pad 38 as a whole has an outside diameter slightly larger than the outside diameter of the plate-shaped workpiece W. The carrying pad 38 is formed on the lower side thereof with a circular projected portion 38*a* having a diameter slightly smaller than the overall diameter of the carrying pad 38.

While the details will be described later, the lower surface of the projected portion 38*a* has an area substantially equal to or larger than the area of the wafer W1 when set to face the upper surface of the wafer W1. While a case where the outside diameter of the projected portion 38*a* is slightly greater than the outside diameter of the wafer W1 is illustrated in FIG. 2, the outside diameter of the projected portion 38*a* may be equal to the outside diameter of the wafer W1.

The carrying pad 38 and the shaft portion 36*a* are formed with a through-hole 38*b* in the center thereof. The through-hole 38*b* is connected with a water supply source 81 through a valve 80.

In addition, at an outer peripheral portion of the carrying pad 38 that is on the outside of the projected portion 38*a*, there are provided holding sections 82 for holding the protruding portion Wa of the plate-shaped workpiece W. A plurality of (for example, three) holding sections 82 are provided at equal intervals along the circumferential direction (in FIG. 2, only two of the holding sections 82 are depicted). Each of the holding sections 82 includes a shaft portion 83 penetrating the carrying pad 38 in the vertical direction in the vicinity of the outer periphery of the carrying pad 38, a suction portion 84 provided at a lower end of the shaft portion 83, and a stopper portion 85 provided at an upper end of the shaft portion 83.

The suction portion 84 has a truncated conical shape increasing in diameter in the downward direction, and is formed of an elastic material such as rubber, for example. The stopper portion 85 has a circular disk-like shape larger in diameter than the shaft portion 83, and functions to prevent the shaft portion 83 and the suction portion 84 from falling off. Each holding section 82 is formed therein with a communication passage (not depicted) communicating with the suction portion 84, and the communication passage is connected with a suction source 87 through a valve 86.

In addition, the holding sections 82 can be lifted up and down in the axial direction. While the details will be described later, the height of the suction portions 84 relative to the carrying pad 38 is controlled by the control means 90 (see FIG. 1) in such a manner as to hold the plate-shaped workpiece W at a predetermined height. Besides, the carrying mechanism 36 as a whole can also be lifted up and down by a lift mechanism which is not illustrated.

Figure 3:
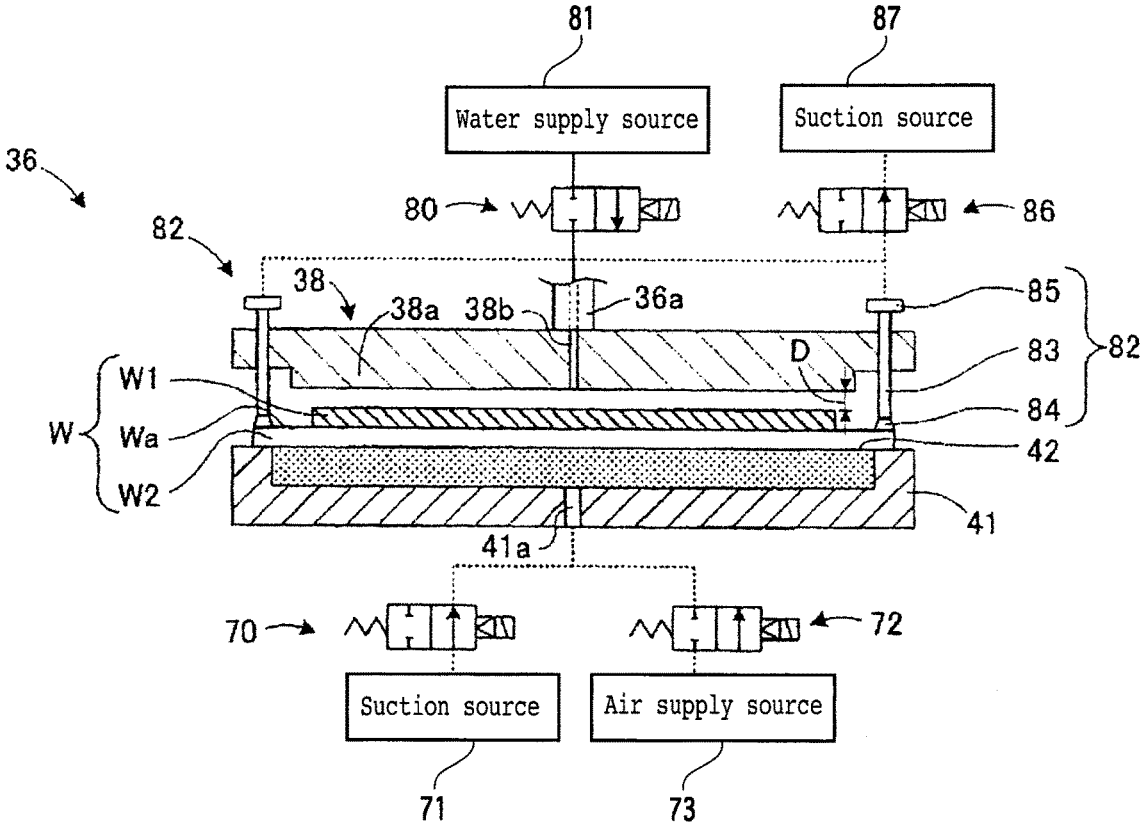
FIG. 3 is a schematic sectional view depicting an example of a holding step of the carrying mechanism according to the present embodiment.
Figure 4A:
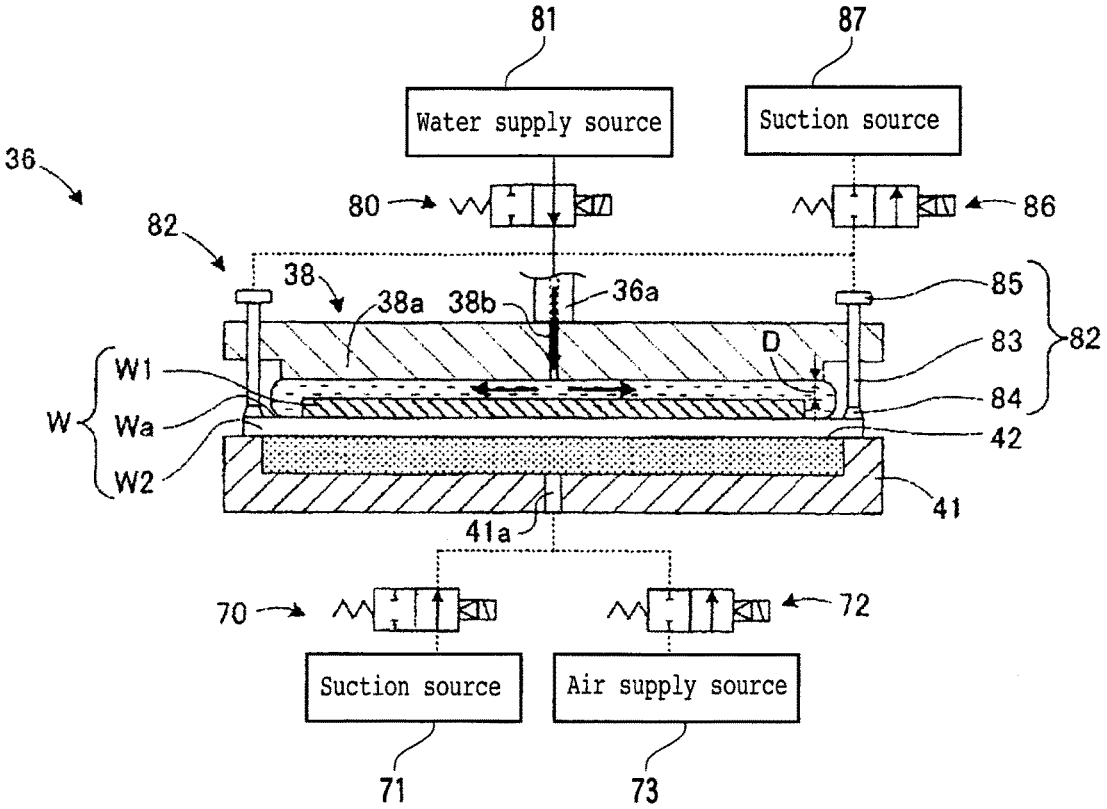
FIG. 4A is a schematic sectional view depicting an example of a water supplying step of the carrying mechanism according to the present embodiment.
Figure 4B:
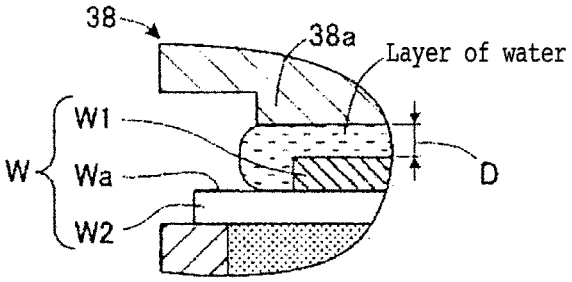
FIG. 4B is a partial enlarged sectional view of the same.
Figure 5:
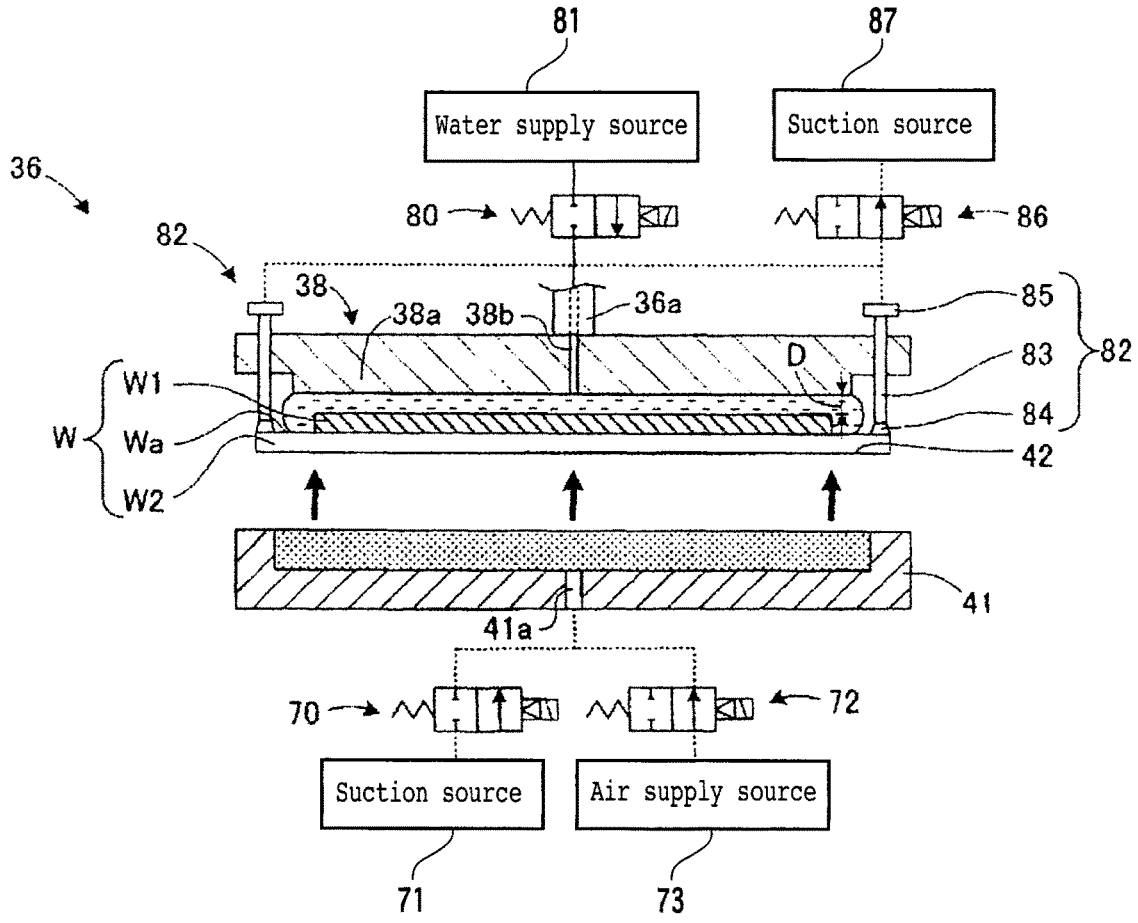
FIG. 5 is a schematic sectional view depicting an example of a separating step of the carrying mechanism according to the present embodiment.

Now, referring to FIGS. 3 to 5, a carrying step of the carrying mechanism according to the present embodiment will be described below. FIG. 3 depicts an example of a holding step of the carrying mechanism according to the present embodiment. FIGS. 4A and 4B depict an example of a water supplying step of the carrying mechanism according to the present embodiment. FIG. 4A is an overall schematic view of the water supplying step, and FIG. 4B is a partial enlarged view of the vicinity of the wafer of FIG. 4A. FIG. 5 depicts an example of a separating step of the carrying mechanism according to the present embodiment.

The carrying step according to the present embodiment is carried out through a holding step of holding the plate-shaped workpiece W under suction by the carrying mechanism 36 (see FIG. 3), a water supplying step of supplying water to the upper surface of the wafer W1 (see FIGS. 4A and 4B), and a separating step of separating (spacing) the plate-shaped workpiece W from the holding table 41 (see FIG. 5).

As depicted in FIG. 3, in the holding step, the plate-shaped workpiece W is held under suction by the carrying mechanism 36. The carrying mechanism 36 slews the carrying arm 37 (see FIG. 1) to bring the center of the plate-shaped workpiece W on the holding table 41 and the center of the carrying pad 38 into register with each other. Then, the carrying mechanism 36 is lowered by the lift mechanism (not depicted), to be positioned to a height at which the plate-shaped workpiece W can be held. As a result, the upper surface of the plate-shaped workpiece W is covered by the carrying pad 38.

Specifically, the carrying mechanism 36 is positioned at such a height that the gap between the lower surface of the projected portion 38*a* and the upper surface of the wafer W1 is a predetermined gap D, after the lower ends of the suction portions 84 make contact with the upper surface of the protruding portion Wa. In this instance, the holding sections 82 are in the state of being raised relative to the carrying pad 38. As above-mentioned, the height of the suction portions 84 relative to the carrying pad 38 is controlled by the control means 90 (see FIG. 1) in such a manner as to form the predetermined gap D. When the predetermined gap D is formed, the valve 86 is opened, whereby a negative pressure is generated at the suction portions 84. As a result, the protruding portion Wa is held under suction by the suction portions 84.

As illustrated in FIGS. 4A and 4B, in the water supplying step, water is supplied to the upper surface of the wafer W1. Specifically, as depicted in FIG. 4A, the valve 80 is opened, whereby water is supplied from the water supply source 81 to the carrying pad 38 via the through-hole 38*b*. The water is supplied via the lower surface of the projected portion 38*a* into the gap D between the projected portion 38*a* and the plate-shaped workpiece W. The water flows through the gap D toward the outer periphery of the wafer W1. As a result, the gap D is filled up with water. Specifically, a layer of water is formed between the lower surface of the projected portion 38*a* and the wafer W1, and the upper surface of the wafer W1 is entirely covered with the water.

More specifically, as depicted in FIG. 4B, due to the surface tension of water between the projected portion 38*a* and the plate-shaped workpiece W, the water is held in such a manner as to slightly swell radially outward from the outer edge portion of the projected portion 38*a*. In other words, a state results in which an outer peripheral portion (side surface) of the wafer W1 is also covered with the water. When the gap D is filled up with the water, the valve 80 is closed, to cut off the supply of water from the water supply source 81. Thus, in the present embodiment, the predetermined gap D is set such that the layer of water can be held between the projected portion 38*a* and the wafer W1 by the surface tension, whereby it is ensured that it is unnecessary to supply water any more and, hence, a water-saving effect can be obtained.

As illustrated in FIG. 5, in the separating step, the plate-shaped workpiece W is separated from the holding table 41. Specifically, the valve 70 is closed whereas the valve 72 is opened, whereby the plate-shaped workpiece W is floated up (separated) from the holding table 41. The carrying mechanism 36 is raised while maintaining the predetermined gap D and the layer of water as depicted in FIGS. 4A and 4B. In this instance, the height of the holding sections 82 relative to the carrying pad 38 is held (fixed) in the state of FIGS. 4A and 4B. Then, the carrying mechanism 36 slews the carrying arm 37, thereby carrying the plate-shaped workpiece W to the cleaning means 26 (see FIG. 1, for both of them). During the carrying, the wafer W as a whole (the gap D) is covered with (filled up with) water, so that drying does not occur.

Thus, according to the present embodiment, the lower surface of the carrying pad 38 has an area equal to or larger than the area of the upper surface of the wafer W1; therefore, with the center of the carrying pad 38 and the center of the wafer W1 put in register with each other, at the time of carrying the plate-shaped workpiece W, the upper surface of the wafer W1 is entirely covered by the carrying pad 38. In addition, with water supplied from the water supply source 81, a layer of water is formed in the gap D between the lower surface of the carrying pad 38 and the upper surface of the wafer W1. In this instance, due to the surface tension of water between the carrying pad 38 and the wafer W1, the layer of water is held in the gap D, so that it is unnecessary to continue supplying water. In other words, the wet state of the upper surface of the wafer W1 can be maintained with a predetermined amount of water. Therefore, the wafer W1 can be carried with its upper surface kept in a wet state, while suppressing the consumption of water.

While a configuration in which the plate-shaped workpiece W having the wafer W1 and the substrate W2 stacked on each other is carried has been described in the above embodiment, this configuration is not limitative. The plate-shaped workpiece to be carried can be modified appropriately. While a configuration in which the side surface of the wafer W1 is also covered with water has been depicted in the above embodiment, this configuration is not restrictive. The side surface of the wafer W1 may not necessarily be covered with water.

In addition, the embodiment of the present invention is not limited to the above embodiment, and various changes, substitutions, and modifications may be made without departing from the gist of the technical thought of the present invention. Further, if the technical thought of the present invention can be embodied in other ways by the advance of technology or by another derived technology, the present invention may be carried out using the relevant method. Therefore, the appended claims cover all the modes that fall within the scope of the technical thought of the present invention.

While a configuration in which the plate-shaped workpiece W is carried in the CMP polishing apparatus 1 has been taken as an example of application of the present invention in the above embodiment, this is not limitative. The present invention is applicable to any processing apparatus in which a plate-shaped workpiece W is to be carried in a wet state.

As has been described above, the present invention has an advantageous effect such that a wafer can be carried with its surface kept in a wet state while suppressing the consumption of water, and the invention is particularly useful when applied to a processing apparatus provided with a carrying mechanism for carrying a wafer stacked with a substrate.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A processing apparatus comprising:

a holding table that holds a substrate of a plate-shaped workpiece under suction including a wafer and the substrate stacked on each other with their centers in register, the substrate being larger than the wafer in area, the substrate protruding to outside of an outer periphery of the wafer to form a protruding portion;

processing means for processing an upper surface of the wafer of the plate-shaped workpiece held by the holding table;

cleaning means for cleaning a processed surface of the wafer having been processed by the processing means; and a carrying mechanism that carries the wafer from the holding table to the cleaning means, wherein the carrying mechanism includes a holding section that holds the protruding portion, a carrying pad that has a lower surface destined to face the upper surface of the wafer of the plate-shaped workpiece held by the holding section, with the lower surface of the carrying pad being equal to or larger than the upper surface of the wafer in area, and water supplying means for supplying water via the lower surface of the carrying pad, and a gap is provided between the upper surface of the plate-shaped workpiece held by the holding section and the lower surface of the carrying pad, water is supplied into the gap by the water supplying means, then, when the gap is filled up with the water, the supply of water from the water supplying means is cut off, and the plate-shaped workpiece is carried from the holding table to the cleaning means with the gap kept filled up with the water.

* * * * *